US009750298B2

(12) United States Patent
Summerville

(10) Patent No.: US 9,750,298 B2
(45) Date of Patent: Sep. 5, 2017

(54) SHOCK-ABSORBING FACE GUARD CONNECTOR FOR ATHLETIC HELMET

(71) Applicant: Hobart-Mayfield LLC, St. Clair Shores, MI (US)

(72) Inventor: Justin H. Summerville, St. Clair Shores, MI (US)

(73) Assignee: Hobart-Mayfield LLC, St. Clair Shores, MI (US)

( * ) Notice: Subject to any disclaimer, the term of this patent is extended or adjusted under 35 U.S.C. 154(b) by 0 days.

(21) Appl. No.: 15/179,414

(22) Filed: Jun. 10, 2016

(65) Prior Publication Data

US 2016/0360819 A1 Dec. 15, 2016

Related U.S. Application Data

(60) Provisional application No. 62/173,467, filed on Jun. 10, 2015.

(51) Int. Cl.

| | |
|---|---|
| ***A41D 13/00*** | (2006.01) |
| ***A42B 3/20*** | (2006.01) |
| ***A63B 71/10*** | (2006.01) |

(52) U.S. Cl.

CPC ..... *A42B 3/20* (2013.01); *A63B 71/10* (2013.01)

(58) Field of Classification Search

CPC ..... A42B 3/20; A42B 3/222

USPC ..... 2/9, 424, 425

See application file for complete search history.

(56) References Cited

U.S. PATENT DOCUMENTS

| | | | | |
|---|---|---|---|---|
| 1,892,943 | A | 1/1933 | Geyer | |
| 3,854,146 | A | 12/1974 | Dunning | |
| 4,086,664 | A * | 5/1978 | Humphrey | A42B 3/20 2/9 |
| 4,271,537 | A * | 6/1981 | Bowlus | A42B 3/063 2/424 |
| 4,390,995 | A | 7/1983 | Walck | |
| 4,633,531 | A | 1/1987 | Nimmons | |
| 4,837,866 | A | 6/1989 | Rector et al. | |
| 6,079,053 | A | 6/2000 | Clover, Jr. et al. | |
| 7,146,652 | B2 | 12/2006 | Ide et al. | |
| 8,819,871 | B2 | 9/2014 | Maddux et al. | |
| 2011/0214224 | A1 | 9/2011 | Maddux et al. | |
| 2011/0271428 | A1* | 11/2011 | Withnall | A42B 3/20 2/422 |
| 2017/0056752 | A1* | 3/2017 | Tubbs | A42B 3/20 |

* cited by examiner

*Primary Examiner* — Tejash Patel
(74) *Attorney, Agent, or Firm* — Reising Ethington P.C.

(57) ABSTRACT

A shock-absorbing face guard connector for an athletic helmet such as a helmet worn in American football, ice hockey, cricket, or baseball and softball. The shock-absorbing face guard connector couples a face guard to the athletic helmet, and can absorb some or all of the forces resulting from a strike to the face guard amid play. The shock-absorbing face guard connector includes a compressible piece that can compressible yield when the face guard is struck.

13 Claims, 2 Drawing Sheets

SHOCK-ABSORBING FACE GUARD CONNECTOR FOR ATHLETIC HELMET

CROSS-REFERENCE TO RELATED APPLICATIONS

This application claims the benefit of U.S. provisional patent application No. 62/173,467 filed Jun. 10, 2015, the entire contents of which are hereby incorporated by reference.

FIELD OF THE DISCLOSURE

The present disclosure relates generally to athletic helmets, and more particularly to a connector for coupling a face guard to an athletic helmet.

BACKGROUND OF THE DISCLOSURE

Athletic helmets are worn by participants in many sports and activities such as American football, ice hockey, cricket, and baseball and softball. In American football, for instance, a face guard is commonly coupled to the helmet in order to provide some level of protection to the wearer's face. The coupling between the face guard and helmet is typically a rigid one. Consequently, when the face guard is struck by an opponent amid play or impacted in some other way, the resulting forces are transmitted from the face guard and through the coupling and through the helmet to the wearer.

SUMMARY

In one embodiment, a shock-absorbing face guard connector for an athletic helmet may include a base, a compressible piece, a plate, and a fastener. The base has a first bore that spans therethrough for receiving a section of a face guard. The base also has a cavity. The compressible piece is received in the cavity of the base, and has a second bore spanning therethrough. The plate is situated at the base, and has a third bore spanning therethrough. The fastener extends through the cavity of the base, extends through the second bore of the compressible piece, and extends through the third bore of the plate. The fastener is employed to attach the shock-absorbing face guard connector to the athletic helmet. When the shock-absorbing face guard connector is assembled and installed on the athletic helmet, and when the face guard is struck, the base is displaced relative to the plate and is displaced relative to the fastener. The base compresses the compressible piece upon this displacement and, hence, shock associated with the strike to the face guard is absorbed in part or more by way of the compressible piece.

In another embodiment, a shock-absorbing face guard connector for an athletic helmet may include a base, a compressible piece, a plate, and a fastener assembly. When the shock-absorbing face guard connector is assembled and installed on the athletic helmet, and when the face guard is struck in a first direction, the compressible piece is compressed and thereby absorbs a portion or more of the shock associated with the strike to the face guard. And when the face guard is struck in a second direction, abutment between the base and the plate precludes compressing of the compressible piece.

BRIEF DESCRIPTION OF THE DRAWINGS

The following detailed description of an embodiment is set forth with reference to the accompanying drawings, in which.

DETAILED DESCRIPTION OF DISCLOSED EMBODIMENTS

Figure 1:
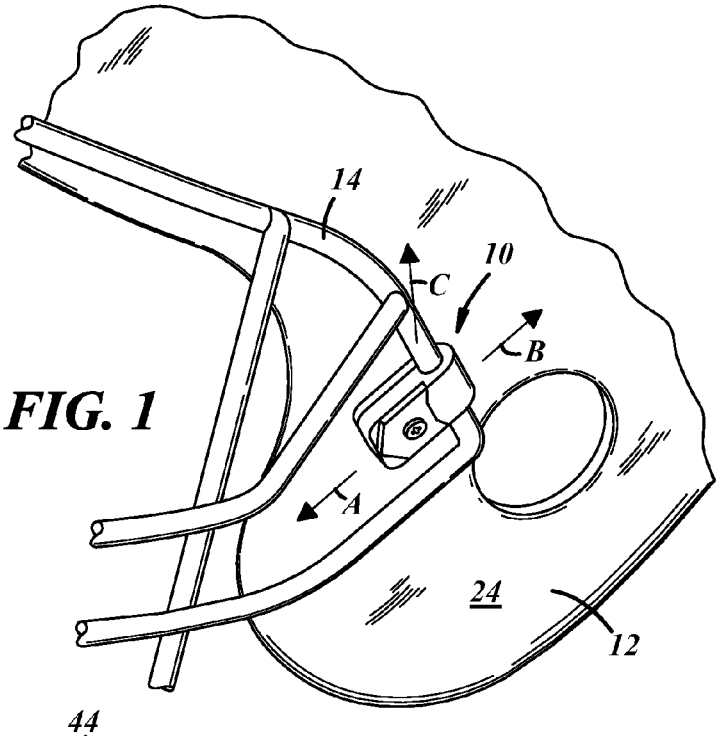
FIG. 1 is a perspective view of an embodiment of a shock-absorbing face guard connector coupling a face guard to an athletic helmet.
Figure 3:
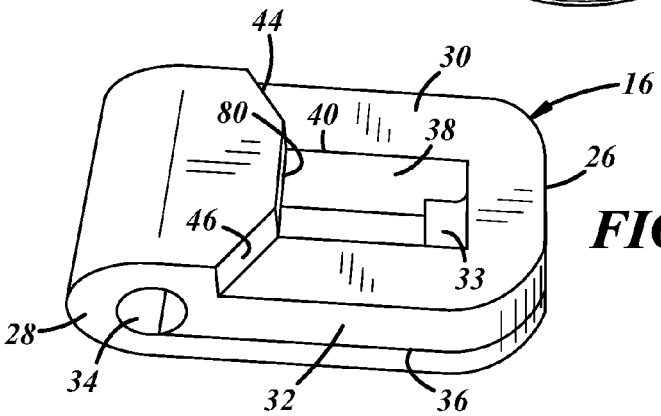
FIG. 3 is a perspective view of an embodiment of a base of the shock-absorbing face guard connector of FIG. 1.

Referring in more detail to the drawings, the figures illustrate one embodiment of a shock-absorbing face guard connector 10 (hereafter "connector") for an athletic helmet 12 such as a helmet worn in American football, ice hockey, cricket, or baseball and softball. The connector 10 couples a face guard 14 to the athletic helmet 12, and absorbs some or all of the forces resulting from a strike to the face guard 14 amid play. The wearer of the athletic helmet 12 is hence spared at least part of the forces that might otherwise be felt more directly. The coupling between the athletic helmet 12 and face guard 14 can involve several connectors 10 at different locations on the athletic helmet 12 and face guard 14. Absorbing forces from strikes and other types of impacts is perhaps mostly sought and beneficial in youth sports and activities, though its application is broader and may be embraced by collegiate and professional sports as well.

The connector 10 can have different designs, constructions, and components than those described and depicted here. In the embodiment presented by FIGS. 1-8, the connector 10 includes a base 16, a compressible piece 18, a plate 20, and a fastener assembly 22.

The base 16 receives and holds a section of the face guard 14, and sits directly against an outer surface 24 of the athletic helmet 12. Referring to FIGS. 2-5, the base 16 can have a one-piece structure, and can be composed of a hard plastic material or a metal material. The base 16 has a front wall 26, a back wall 28, a first side wall 30, and a second side wall 32. In the embodiment here, both the front wall 26 and back wall 28 have a step structure situated thereat. A first step 33 serves as a ledge for the compressible piece 18, and a second step 35 also serves as a ledge for the compressible piece 18. In other embodiments, a step structure could be situated at the first and/or second side walls 30, 32 and need not necessarily be situated at the front and back walls 26, 28. A first bore 34 is defined through the back wall 28, and receives the section of the face guard 14 when the connector 10 is employed to couple the face guard 14 to the athletic helmet 12—this coupling is perhaps shown best by FIGS. 1 and 2. To initially receive the face guard 14, the base 16 has a slit 36 spanning from the first bore 34 and through the front wall 26. The slit 36 spans completely through the first and second side walls 30, 32 so that the base 16 can open up and accept the face guard 14 into the first bore 34.

A cavity 38 is defined in part by inner surfaces of the front wall 26, back wall 28, first side wall 30, and second side wall 32. The cavity 38 is also defined in part by surfaces of the first and second steps 33, 35. When the connector 10 is assembled in use, the cavity 38 receives the compressible piece 18. The cavity 38 has an open top side 40 and an open bottom side 42. In the assembly procedure, the compressible piece 18 can be inserted into the open top side 40 or into the open bottom side 42. The top side of the base 16 has a stepped-cutout design and construction with a first notched recess 44 and a second notched recess 46. As will be described in greater detail below, the first and second notched recesses 44, 46 constitute one-half of an extension-recess interfit that somewhat pilots movement of the connector 10 when the face guard 14 is struck or otherwise impacted amid use of the athletic helmet 12.

Figure 2:
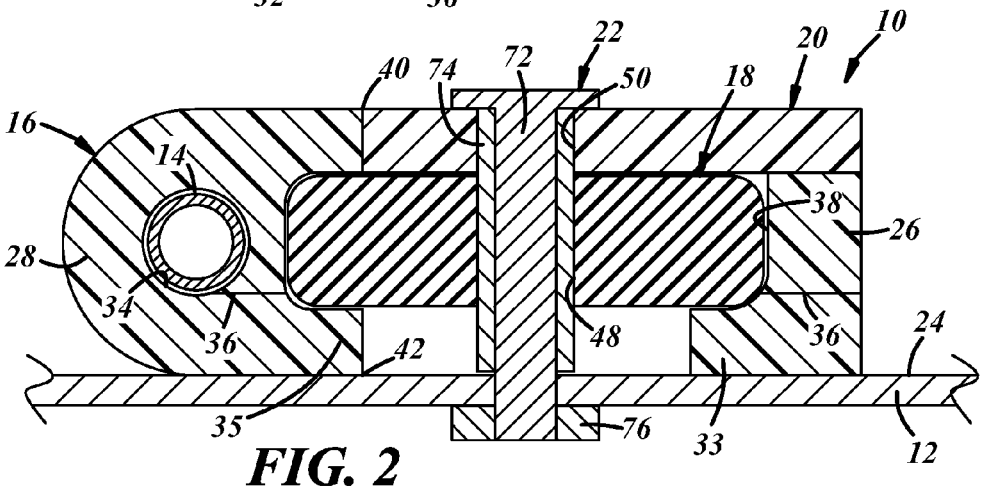
FIG. 2 is a sectional view of the shock-absorbing face guard connector of FIG. 1.
Figure 4:
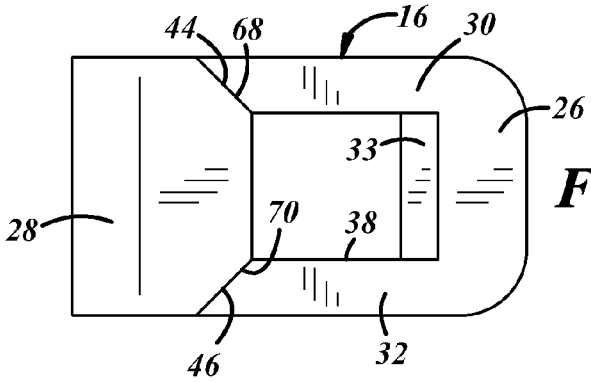
FIG. 4 is a top view of the base of FIG. 3.
Figure 5:
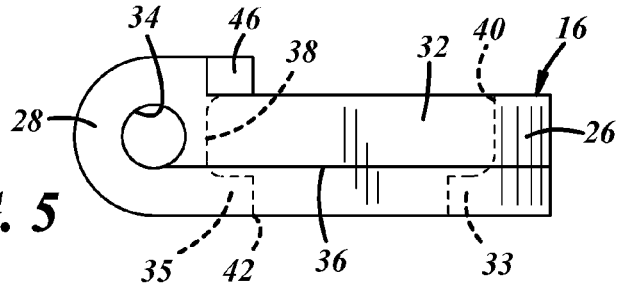
FIG. 5 is a side view of the base of FIG. 3.
Figure 6:
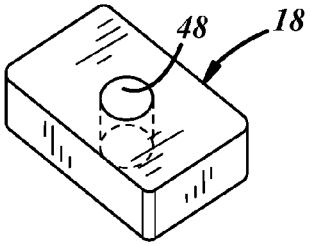
FIG. 6 is a perspective view of an embodiment of a plate of the shock-absorbing face guard connector of FIG. 1.

The compressible piece 18 is capable of compressibly yielding during use of the connector 10 in order to absorb the shock of forces that the helmet wearer might otherwise more acutely experience. Referring now to FIGS. 2 and 6, the compressible piece 18 can be composed of a rubber or a foam material, and can be sized and constructed for reception within the cavity 38. The compressible piece 18 sits on top of the first and second steps 33, 35. A second bore 48 is defined completely through the compressible piece 18 between a top side and a bottom side. The second bore 48 receives the fastener assembly 22 when the connector 10 is assembled together, as perhaps illustrated best in FIG. 2. Apart from the second bore 48, the compressible piece 18 has a solid and one-piece structure.

Figure 7:
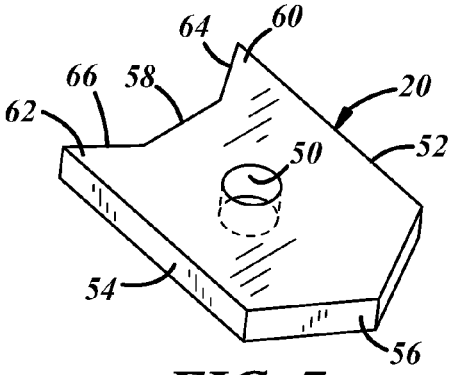
FIG. 7 is a perspective view of an embodiment of a compressible piece of the shock-absorbing face guard connector of FIG. 1.

The plate 20 is situated at the top side of the base 16 and is exposed outwardly when the connector 10 is assembled in use on the athletic helmet 12, as perhaps shown best in FIG. 1. Since it is exposed, the plate 20 could be colored or decorated in another way to match an athletic jersey accompanying the athletic helmet 12. Referring now to FIGS. 2 and 7, the plate 20 can be composed of a hard plastic material or a metal material. A third bore 50 is defined completely through the plate 20 between a top side and a bottom side of the plate 20. The third bore 50 receives the fastener assembly 22 when the connector 10 is assembled together, as perhaps illustrated best in FIG. 2. Apart from the third bore 50, the plate 20 has a solid and one-piece structure.

The plate 20 has a first side surface 52 and a second side surface 54. The distance between the first and second side surfaces 52, 54 can be the same as that between the first and second side walls 30, 32 of the base 16. At a front surface 56, the plate 20 can come to a point as shown in FIG. 7, though need not. Near a back surface 58, the plate 20 has a first extension 60 and a second extension 62 that constitute the other half of the extension-recess interfit that somewhat pilots movement of the connector 10. The first extension 60 is sized and shaped complementary to the first notched recess 44 so that the two fit together in assembly, and likewise the second extension 62 is sized and shaped complementary to the second notched recess 46 so that the two fit together in assembly. Indeed, slanted surfaces 64, 66 of the first and second extensions 60, 62 complement slanted surfaces 68, 70 (FIG. 4) of the first and second notched recesses 44, 46; the slanted directions referred to here are with respect to directions defined by the lengths of the first and second side surfaces 52, 54. In other embodiments not depicted in the figures, the sizes and shapes of the extension-recess interfit can differ, while still furnishing the somewhat piloted movement functionality described below; for instance, one or more of the surfaces 64, 66, 68, 70 could be stepped and not need necessarily be slanted, and/or the plate 20 could be recessed while the base has complementary extensions. Still further, the connector 10 could altogether lack the extension-recess interfit in some embodiments.

Figure 8:
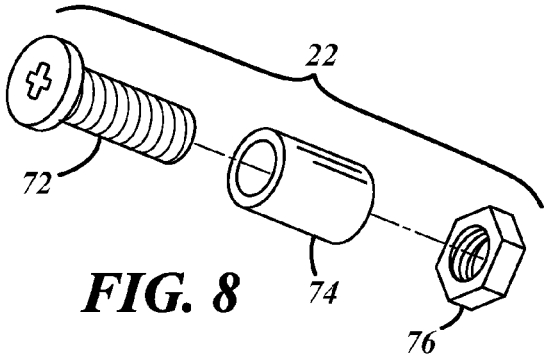
FIG. 8 is an exploded view of an embodiment of a fastener assembly of the shock-absorbing face guard connector of FIG. 1.

The fastener assembly 22 attaches the connector 10 to the athletic helmet 12, and holds it thereagainst. Referring now to FIGS. 2 and 8, in this embodiment the fastener assembly 22 includes a fastener such as a bolt 72, a sleeve 74, and a nut 76. In other embodiments, the fastener assembly 22 need not necessarily include all of these components, and could include other components. The bolt 72 has a threaded shank extending from a head. The sleeve 74 is a hollow tube that receives insertion of the bolt's threaded shank. And the nut 76 tightens around the bolt's threaded shank. With reference particularly to FIG. 2, in assembly the fastener assembly 22 extends through the third bore 50 of the plate 20, extends through the second bore 48 of the compressible piece 18, and extends through the cavity 38 of the base 16. Further, a terminal end of the bolt 72 extends through the athletic helmet 12, and the nut 76 is tightened down over the bolt's terminal end at a back side of the athletic helmet 12. Although not depicted here, the plate 20 could have a countersunk bore so that the bolt's head would sit flush with a top side of the plate 20.

In use, the connector 10 absorbs some or all of the forces exerted from a strike to the face guard 14, or from some other type of impact to the face guard 14. For instance, when the face guard 14 is struck, the face guard 14 itself and the base 16 of the connector 10 are displaced by the strike relative to the athletic helmet 12, relative to the plate 20, and relative to the components of the fastener assembly 22. The compressible piece 18 is squeezed by the base 16 against the fastener assembly 22, and hence takes-in and absorbs at least some of the energy and forces exerted by the strike. After the strike, the compressible piece 18 urges and returns to its previous size and shape, and returns the base 16 and the face guard 14 to their respective previous positions.

In an embodiment in which the connector 10 has the plate 20 as illustrated in the figures, and has the extension-recess interfit, the connector 10 precludes movement of the face guard 14 in at least one direction and can facilitate guidance of displacement of the face guard 14 in more than one direction. When the face guard 14 is pulled in a direction A (FIG. 1), for instance, abutment between the base 16 and the plate 20 precludes and physically restricts movement of the face guard 14; that is, the base 16 is not displaced relative to the athletic helmet 12, and the compressible piece 18 remains substantially unsqueezed. The direction A in this example is generally parallel to and along a lengthwise extent of the connector 10 as shown from left-to-right and right-to-left in the sectional view of FIG. 2. The abutment between the base 16 and the plate 20 specifically involves abutment between: i) a surface 80 of the back wall 28 and slanted surfaces 68, 70 of the first and second notched recesses 44, 46, and ii) the back surface 58, including slanted surfaces 64, 66 of the first and second extensions 60, 62. When the face guard 14 is pushed, on the other hand, in a direction B (FIG. 1), the face guard 14 and the base 16 are displaced and move in the direction B while the plate 20 remains in place with the fastener assembly 22 and with the athletic helmet 12 also remaining in place. The direction B in this example is opposite the direction A. The compressible piece 18 is squeezed in this instance.

Of course, the face guard 14 can be pushed and pulled in other directions amid play. As but one additional example, when the face guard 14 is pushed in a direction C (FIG. 1), surface-to-surface sliding between the slanted surfaces 64, 68 or between the slanted surfaces 66, 70 can guide movement of the face guard 14 and base 16 as they are displaced away from the plate 20. The direction C is generally parallel to planes defined by the respective slanted surfaces experiencing surface-to-surface sliding. In some instances, this surface-to-surface sliding and concomitant guiding provides a more controlled shock absorbing functionality than might otherwise be the case. Still, other actions and movements and guidance could occur when the face guard 14 is pushed and pulled amid play.

While the forms of the disclosure described constitute presently preferred embodiments, many others are possible. It is not intended herein to mention all the possible equivalent forms or ramifications of the disclosure. It is understood that the terms used herein are merely descriptive, rather than limiting, and that various changes may be made without departing from the spirit or scope of the invention.

The invention claimed is:

1. A shock-absorbing face guard connector for an athletic helmet, the shock-absorbing face guard connector comprising:

a base having a first bore spanning therethrough for receiving a section of a face guard, said base having a cavity;

a compressible piece received in said cavity of said base, said compressible piece having a second bore spanning therethrough;

a plate situated at said base, said plate having a third bore spanning therethrough; and a fastener extending through said cavity of said base, extending through said second bore of said compressible piece, and extending through said third bore of said plate, said fastener for attaching the shock-absorbing face guard connector to the athletic helmet;

wherein, in assembly and installation on the athletic helmet, when the face guard is struck, said base is displaced relative to said plate and relative to said fastener, said base compressing said compressible piece upon displacement, and hence shock associated with the strike to the face guard is absorbed at least in part via said compressible piece.

2. A shock-absorbing face guard connector as set forth in claim 1, wherein said base has a front wall, a back wall, a first side wall, and a second side wall, said front, back, first side, and second side walls at least partly defining said cavity, and said cavity having an open top side and an open bottom side.

3. A shock-absorbing face guard connector as set forth in claim 2, wherein at least one of said front wall, back wall, first side wall, or second side wall has a step situated thereat, said compressible piece seated on said step.

4. A shock-absorbing face guard connector as set forth in claim 1, wherein said plate is situated at a top side of said base and is exposed during use of the shock-absorbing face guard connector.

5. A shock-absorbing face guard connector as set forth in claim 1, wherein said base and said plate interfit with each other via an extension-recess interfit, wherein said extension-recess interfit guides displacement of said base in at least one direction via surface-to-surface sliding between surfaces of said extension-recess interfit.

6. A shock-absorbing face guard connector as set forth in claim 5, wherein said extension-recess interfit includes at least a pair of slanted surfaces, and the surface-to-surface sliding occurs between said at least pair of slanted surfaces.

7. A shock-absorbing face guard connector as set forth in claim 5, wherein said extension-recess interfit includes a first notched recess of said base and a second notched recess of said base, and said extension-recess interfit includes a first extension of said plate and a second extension of said plate.

8. A shock-absorbing face guard connector as set forth in claim 1, further comprising a fastener assembly including said fastener, a sleeve, and a nut, said fastener extending through said sleeve, said sleeve extending through said cavity of said base and extending through said second bore of said compressible piece and extending through said third bore of said plate, said nut threading onto said fastener for attaching the shock-absorbing face guard connector to the athletic helmet.

9. A shock-absorbing face guard connector as set forth in claim 1, wherein, when the face guard is struck, abutment between said base and said plate precludes displacement of said base relative to said plate and relative to said fastener in at least one direction.

10. A shock-absorbing face guard connector for an athletic helmet, the shock-absorbing face guard connector comprising:

a base having a first bore spanning therethrough for receiving a section of the face guard, and said base having a cavity;

a compressible piece received in said cavity of said base, and said compressible piece having a second bore spanning therethrough;

a plate; and a fastener assembly;

wherein, when assembled and installed on the athletic helmet, and when a face guard is struck in a first direction, said compressible piece is compressed and absorbs at least a portion of shock associated with the strike to the face guard; and wherein, when assembled and installed on the athletic helmet, and when the face guard is struck in a second direction, abutment between said base and said plate precludes compressing of said compressible piece.

11. A shock-absorbing face guard connector as set forth in claim 10, wherein said plate is situated at said base, and said plate has a third bore spanning therethrough.

12. A shock-absorbing face guard connector as set forth in claim 11, wherein said fastener assembly extends through said cavity of said base, extends through said second bore of said compressible piece, and extends through said third bore of said plate, said fastener assembly for attaching the shock-absorbing face guard connector to the athletic helmet.

13. A shock-absorbing face guard connector as set forth in claim 10, wherein the abutment between said base and said plate that precludes compressing of said compressible piece involves an extension-recess interfit of said base and said plate.

* * * * *